US005615738A

United States Patent [19]

Cameron et al.

[11] Patent Number: 5,615,738

[45] Date of Patent: Apr. 1, 1997

[54] INTERNAL BYPASS VALVE FOR A HEAT EXCHANGER

[75] Inventors: Gordon M. Cameron, Willowdale; Charles G. Cooper; Gregory J. Bellamy, both of Vancouver, all of Canada

[73] Assignee: Cecebe Technologies Inc., Willowdale, Canada

[21] Appl. No.: 268,183

[22] Filed: Jun. 29, 1994

[51] Int. Cl.[6] ..... F28F 27/02

[52] U.S. Cl. ..... 165/103; 165/159; 165/DIG. 123; 165/DIG. 416

[58] Field of Search ..... 165/159, 161, 165/100–103, 40

[56] References Cited

U.S. PATENT DOCUMENTS

| | | | |
|---|---|---|---|
| 1,812,458 | 6/1931 | Turkus | 165/159 X |
| 1,833,611 | 11/1931 | Kirgan | 165/103 |
| 1,918,966 | 7/1933 | Harkness | 165/101 |
| 2,511,647 | 6/1950 | Marshall | 165/159 X |
| 3,741,164 | 6/1973 | Barratt | 165/159 X |
| 5,014,740 | 5/1991 | Cameron | 137/561 A |
| 5,044,431 | 9/1991 | Cameron | 165/158 |
| 5,113,928 | 5/1992 | Myers | 165/103 X |

FOREIGN PATENT DOCUMENTS

| | | | |
|---|---|---|---|
| 116296 | 6/1986 | Japan | 165/103 |
| 197996 | 9/1986 | Japan | 165/159 |
| 14094 | 1/1988 | Japan | 165/96 |
| 365 | 1/1894 | United Kingdom | 165/100 |

*Primary Examiner*—Leonard R. Leo

*Attorney, Agent, or Firm*—Bereskin & Parr Philip Mendes da Costa

[57] ABSTRACT

A shell and tube heat exchanger for exchanging heat between a shell side fluid and a tube side fluid has a longitudinally extending shell, a longitudinally extending tube bundle and one or more baffles positioned within the shell for directing the shell side fluid to flow across the tube bundle. One or more valves is also provided within the shell of the heat exchanger. Each valve is operable between a first position and a second position and co-operates with a baffle for adjusting the flow of shell side fluid through the shell side of the exchanger. Each of the valves is controlled by an external actuator.

25 Claims, 8 Drawing Sheets

INTERNAL BYPASS VALVE FOR A HEAT EXCHANGER

FIELD OF THE INVENTION

This invention relates to an internal bypass valve system suitable for heat exchangers. The internal bypass valve may be used to bypass baffle passes or throttle shell side flow and, by doing so, the amount of heat transferred to or from the shell side fluid may be regulated. Alternately, a shell and tube heat exchanger may be connected in parallel with external bypass flow means whereby shell side fluid may be diverted to the external bypass means so as to flow around the heat exchanger. In this mode of operation, the internal bypass valve may be used to regulate the amount of shell side fluid passing through the heat exchanger as opposed to the external bypass means.

BACKGROUND OF THE INVENTION

Heat exchangers are commonly used in industrial processes. Typically, heat exchange systems are designed to transfer heat from one fluid to another. The design parameters are based upon the anticipated range of temperatures of the hot heat transferring fluid and the cold heat receiving fluid. In some cases, a series of heat exchangers may be in flow communication. In addition, in some cases, the temperature of the hot heat transferring fluid and the cold heat receiving fluid may vary quite dramatically depending upon the feed stock which is used in the process. Exemplary of such a situation is the contact process for sulphuric acid manufacture.

The contact process for sulfuric acid manufacture is commonly used to recover the sulfur values from gases discharged from metallurgical processes and from waste acid regeneration. For these operations, process heat from the oxidation of sulfur dioxide is transferred from converted or partly converted gases to the unconverted gases to heat the unconverted gases to reaction temperatures typically in the range of 400° to 450° C. In a double absorption plant, for example, there may be as many as six or seven heat exchangers in the exchanger train and the total exchanger area in the plant can be as large as 30,000 square meters. Gas flows can be as high as 200,000 normal cubic meters per hour and gas duct sizes can be as large as 2600 mm. Exchanger sizes may be as large as 6 meters in diameter and 25 meters high. A simplified schematic diagram of such an operation is set out in FIG. 1.

Where the gas source is a smelting furnace or acid burning operation, the gas strength produced may vary significantly and the design requirements of the various exchangers will vary in turn. The exchangers are each designed for the most difficult duty likely to arise and in other conditions, the exchanger performance will have to be decreased to satisfy the existing conditions. Such regulation of performance is normally obtained by passing a portion of the unconverted gas through external bypass means around the exchanger and mixing it with the gas passing through the exchanger at the exchanger exit. The mixed gas then passes to the next process operation. In some cases where the range of gas strengths expected in the acid plant is wide, almost total bypassing of some exchangers may be needed and the bypasses must be so designed. In other cases, there may be a need for very good mixing of the process stream before the next operation such as catalysis.

With the large gas flows and the modest pressure losses in the heat exchangers, the external bypass means has typically been a side stream around the exchanger with several changes of direction in addition to a bypass valve, a route with a significant flow resistance. The driving force for flow through the bypass line is the pressure loss through the exchanger. This driving force drops rapidly as the fraction bypassing the exchanger increases. When a high fraction of shell side fluid must bypass the exchanger, it may also be necessary to throttle the flow through the exchanger to create the needed bypass flow. Such throttling may be achieved by providing a valve on the inlet stream to the heat exchanger or by arranging the flow in such a way that the external bypass line is the preferred flow arrangement such as by placing the exchanger on the side stream and the bypass in the main flow stream. In addition, when the two gas streams are rejoined, there may be several hundred degrees differences in temperature between the bypassing stream and the main stream and mixing of the two streams is not automatic. Thus, the temperature of the recombined stream downstream of the exchanger may vary greatly from point to point. Such a temperature gradient is undesirable. For example, the temperature across the top of a catalyst bed should typically not vary by more than one or two degrees which is much less than the hundreds of degrees difference in temperature which may exist at an exchanger exit.

Normally butterfly valves have been used for control of the flow in the external bypass lines because of the size of the ducts. The valves can have many problems including warping of valves bodies because of mechanical and thermal stresses which can cause the valves to jam. In addition, the valves have shaft seals which can leak and allow process gas leakage to the atmosphere where it can cause an environmental nuisance.

Since the unconverted gas in the exchangers is usually colder and does not give a visible plume on leaking, the bypasses have typically been located on the unconverted gas side of the exchanger although there are many cases where the converted gas side might have offered better bypass opportunity.

A further characteristic of exchangers handling gas in contact acid plants is the possibility of tubes with temperatures which lead either to scale formation if the temperature is too hot or to condensation if the metal is too cold. When shell side bypassing takes place around the exchanger the stream of fluid continuing through the exchanger as opposed to the bypass approaches more closely the temperature of the entering tube side fluid and temperatures can be either too high or too low. A bypass operation which offered some protection against this risk would add to plant life and reliability. The external bypass offers no protection against this risk as the whole exchanger is bypassed and the gas is only mixed after leaving the exchanger.

A further feature of exchanger trains found in sulfuric acid plants is that there may be several exchangers in series and external temperature control bypasses may be arranged to bypass several heat exchange steps instead simply of a single step. Such an arrangement often offers very rapid response but saves less in pressure than individual bypasses and it also creates a more severe mixing problem when the multi-step bypass is combined with the main stream.

SUMMARY OF THE INVENTION

In accordance with the instant invention, a shell and tube heat exchanger for exchanging heat between a shell side fluid and a tube side fluid comprises:

a) a longitudinally extending shell;

b) a plurality of tubes extending longitudinally in the shell, the tubes being positioned to define a first longitudinally extending window;

c) baffle means positioned within the shell for directing the shell side fluid to flow across the tubes;

d) valve means positioned within the first longitudinally extending window and operable between a first open position and a second closed position, the valve means co-operating with the baffle means for adjusting the flow of the shell side fluid in the shell; and, e) actuator means coupled to the valve means for moving the valve means between the first and second positions.

As used herein, fluid is used to refer either a gas or a liquid. Preferably, the heat exchanger is a gas to gas heat exchanger. However, the invention is also applicable to liquid to liquid heat exchangers or any other fluid to fluid heat exchangers.

A variety of heat exchanger designs are known in the art. These designs include single segmental baffled units with no tubes in the baffle windows, designs with double segmental designs and no tubes in the outer baffle windows, and designs with no tubes in a central core or in an outer annulus, these spaces being used for fluid transfer in the shell space parallel to the tubes and with radial in and out cross-flow. The internal bypass means of this invention may be used with each of these designs.

While the actuator means itself may be positioned within the heat exchanger, preferably, the means of controlling the movement of the actuator means is positioned external to the heat exchanger. Accordingly, the movement of valve means between the first position and the second position may be controlled from outside the heat exchanger.

In one embodiment of the invention, the tubes are positioned to define a first window extending longitudinally within the shell upstream and downstream of the baffle means and the valve means is positioned within the first window. According to this embodiment, the baffle means may extend substantially across the interior of the shell. When the valve means is in the first position, the shell side fluid may pass through the first window. When the valve means is in the second position, the valve means closes the first window and the valve means and baffle means define a continuous wall within the shell preventing the shell side fluid from passing through the heat exchanger. Such a valve means is referred to herein as a throttling valve.

The heat exchanger according to this embodiment may be used to divert some or all of the shell side fluid which would otherwise flow through the heat exchanger to flow through external bypass means positioned upstream and in flow communication with heat exchanger. Thus, by adjusting the position of the valve means, the amount of shell side fluid diverted through the bypass means can be regulated.

According to an alternate embodiment, the tubes may be positioned to define a first window extending longitudinally within the shell upstream and downstream of the baffle means, the baffle means extends through the first window and the valve means is positioned within the first window and forms part of the baffle means such that, when the valve means is in the first position, the baffle means and the valve means define a continuous surface and the shell side fluid is deflected by the valve means and the baffle means to pass across the tubes, and as the valve means is moved to the second position, the amount of shell side fluid passing through the valve means from a position upstream of the baffle means to a position downstream of the baffle means increases. Such a valve means is referred to herein as a by pass valve.

Preferably, the tubes in the heat exchanger are positioned to define a second window within the shell. The second window may be at a position transversely distal to the baffle means and may extend longitudinally upstream and downstream of the baffle means.

The heat exchanger preferably has a plurality of baffle means and a plurality of valve means. Each of the valve means may have an associated actuator means so that each of the valve means may be independently operable.

By adjusting the position of one or more of the valve means in the heat exchanger, the amount of shell side fluid following each baffle pass through the heat exchanger may be regulated. As will be explained in more detail hereinbelow, by opening a valve means, the amount of shell side fluid being deflected by the baffle means may be reduced thus reducing the amount of heat which will be transferred between the shell side fluid and the tube side fluid. In one embodiment, the heat exchanger includes both throttling valves and by pass valves. The by pass valves may be opened to allow shell side bypassing. Throttling valves may be closed to enhance the shell side bypassing.

BRIEF DESCRIPTION OF THE DRAWINGS

These and other advantages of the instant invention may be more fully and completely understood by means of the following drawings of the preferred embodiments of this invention in which.

DESCRIPTION OF THE PREFERRED EMBODIMENT

Figure 1:
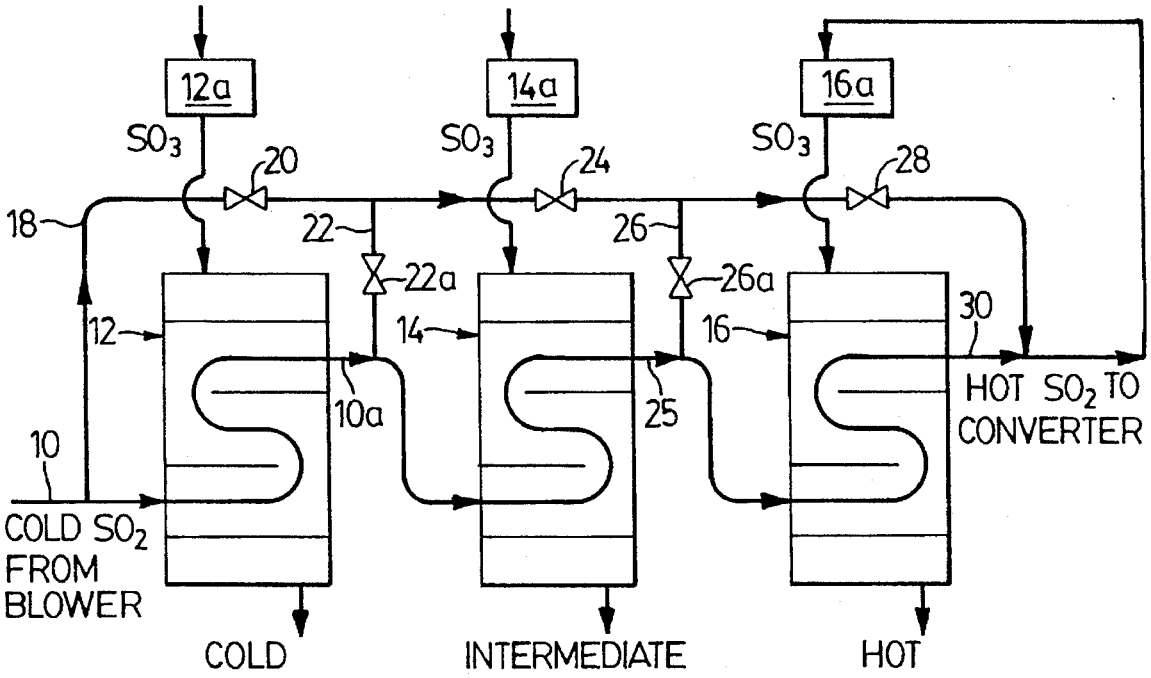
FIG. 1 (PRIOR ART)
FIG. 1 is a schematic view of an external bypass system for a metallurgical sulfuric acid plant according to the prior art.

FIG. 1, which is a simplified schematic of an existing heat exchanger train, and FIGS. 2, 3A, 3B, 4A, 4B, 5A and 5B, which are simplified heat exchanger schematics, will be briefly reviewed so that the advantages of the instant invention will be more fully and particularly appreciated.

FIG. 1 shows in elevation a portion of a sulfuric acid converter having a three exchanger train such as would be found in a standard single absorption sulfuric acid plant. In this Figure, a cold dry $SO_2$ containing stream 10 from a blower (not shown) flows in sequence to three exchangers 12, 14, and 16 which are arranged for $SO_2$ gas flow in series and are known respectively as the cold, intermediate, and hot exchangers. Each exchanger is designed based on the most severe duty it must serve. The three exchangers obtain their heat from $SO_3$ containing gas streams from various catalyst beds, the hot exchanger cooling the gas from bed 16*a*, the intermediate exchanger cooling gas from bed 14*a*, and the cold exchanger cooling gas from the last bed in the converter namely catalyst bed 12*a*.

For the design of the cold exchanger, the most difficult duty arises when the $SO_2$ content of the gas is low and the heat generated by the conversion reaction in the catalyst beds is small. In such a case, the exchanger must cool the gases leaving the last bed to much lower temperatures than when there is more process heat generated in the catalyst bed. Such an exchanger will therefore have a much lower temperature difference between the stream being cooled and the stream being heated and also a higher quantity of heat to transfer and will thus be much bigger than required for more normal operation. On the other hand, when the gas strength is low, the heat generated in catalyst bed 14*a* is very low and the intermediate exchanger requirement for dilute gas is very low. When the gas strength rises, the heat generated in bed 14*a* rises rapidly resulting in the critical design condition for the intermediate exchanger being very strong gas.

The hot exchanger duty also rises with increasing gas strength but the variation with gas strength is much less than in either of the other two exchangers. Clearly, there is unlikely to be any condition in which the full exchanger heat transfer capability can be used in all heat exchangers and mechanisms must be available to regulate the thermal performance of all three exchangers.

Traditionally, a bypass line 18 allows some of the incoming unheated gas (the shell side fluid) to be diverted from cold exchanger 12 and to flow through a control valve 20 and a line 22 to the $SO_2$ exit 10*a* of the cold exchanger 12, thus reducing the flow in the shell space of this exchanger and decreasing the amount of heat transferred to the shell side fluid. By adjusting valve 22*a*, some of the shell side fluid may also flow from valve 20 and line 22 to valve 24 which allows a bypassing of the intermediate exchanger 14. This bypassed gas can then flow either through line 26 to the exit 25 of the intermediate exchanger 14 or by adjusting valve 26*a*, some may flow to the bypass valve 28 which allows gas to flow around the heat exchanger 16. Alternately, a combination of these flow streams may be utilized. The bypass gas from valve 28 and the heated gas 30 from the hot exchanger 16 then combine and flow to the first catalyst bed in the converter 16A.

As shown in FIG. 1, all of the bypasses carry unconverted $SO_2$ containing gases and the $SO_2$ gas streams are shown as flowing through the shell sides of the three exchangers. Although it is also common to have the $SO_2$ gases flow through the shell sides, $SO_2$ gas may also be passed through the tube sides of the exchangers. While the heat exchangers of FIG. 1 show two baffles in each exchanger with single segmental baffles, double segmental baffles, disk and donut baffles and single pass cross-flow designs may also be used. In some cases the intermediate and the hot exchangers may have $SO_2$ flow in parallel through the two exchangers instead of in series as shown in FIG. 1. If the converter has four passes, a bare duct or separate cooling means may be used between the third catalyst bed and a fourth catalyst bed (not shown) as the amount of cooling needed is very small and this cooler has not been shown in FIG. 1.

Figure 2:
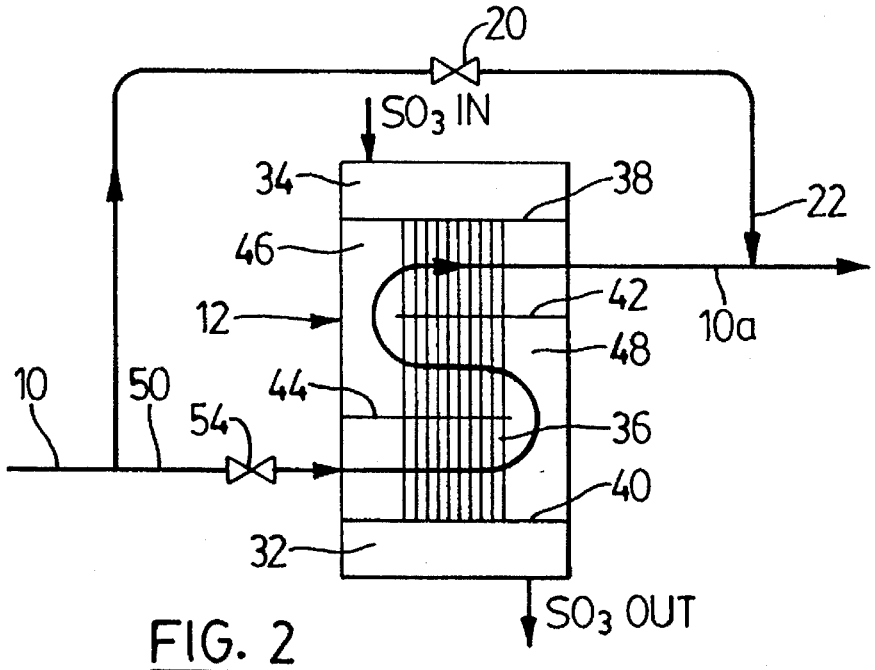
FIG. 2 (PRIOR ART)
FIG. 2 is a schematic view of an external bypass around a single exchanger according to the prior art.

FIG. 2 shows in more detail the bypass around a single segmentally baffled exchanger 12. Exchanger 12 has bottom and top tube side vestibules 32, 34 for the $SO_3$ gas which flows from vestibule 34 to vestibule 32. The tube bundle 36 extends between tube sheets 38, 40 and passes through baffles 42, 44. Baffle windows which contain no tubes are designated as spaces 46, 48. The incoming gas stream 10 flows either through the inlet duct 50 to the exchanger and exits as gas stream 10*a* or through valve 20 and line 22 to gas stream 10*a*. The bypass stream therefore travels through a side branch from the inlet line and passes through several elbows and tees before joining stream 10*a*. All of these changes of direction introduce flow resistance and add stresses to the duct system, requiring expansion joints.

The driving force to cause the gas to flow through the bypass line is the flow resistance through the shell side of the exchanger. When the bypass valve is initially opened, the gas flow through the exchanger is relatively high and the flow through the bypass line is low and it is easy to bypass gas around the exchanger. When the flow through the exchanger further decreases, the pressure difference causing flow through the bypass decreases as the square of the gas flow through the exchanger while, at the same time, the flow through the bypass line increases and so does the flow resistance. The flow through the exchanger is also normally more direct and it is therefore very difficult to get a large flow through the bypass line without adding a valve 54 to throttle the flow through the exchanger. Such a valve may be present for other purposes but full diameter large diameter gas valves are expensive and often difficult to operate and maintain.

Figure 3A:
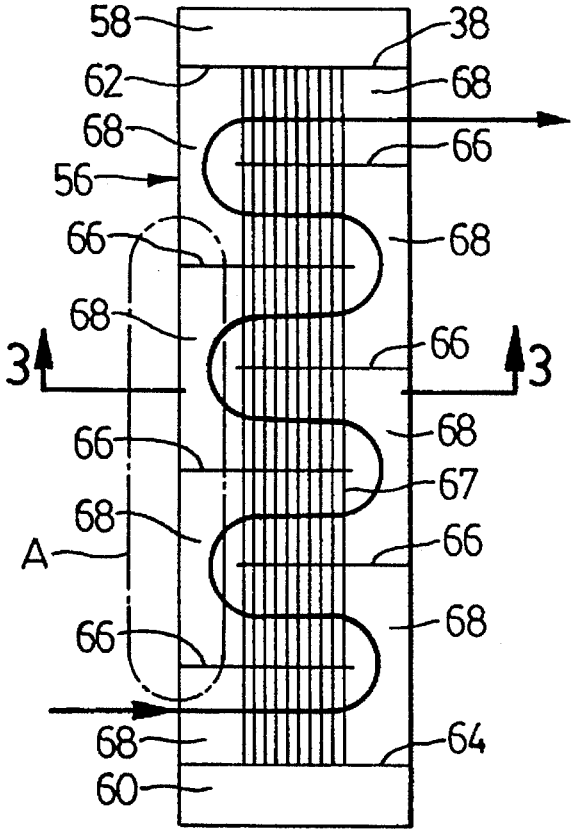
FIG. 3A is a schematic view of a baffle arrangement for a single segmental baffled exchanger with no tubes in the baffle windows according to the prior art.
Figure 3B:
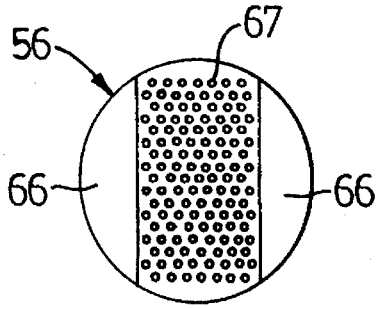
FIG. 3B is a cross-section along line 3—3 in FIG. 3A.

FIGS. 3A and 3B show the typical baffle arrangement for a single segmental baffled exchanger with no tubes in the baffle windows. Exchanger 56 has top and bottom vestibules 58, 60 for the tube side fluid and top and bottom tubesheets 62, 64. Tube bundle 67 contains tubes arranged parallel to the longitudinal axis of the exchanger and extends between tube sheets 58, 60 and is positioned within baffles 66. The window openings are in the spaces between the edge of tube bundle 67 and the shell and are shown as 68.

Figure 4A:
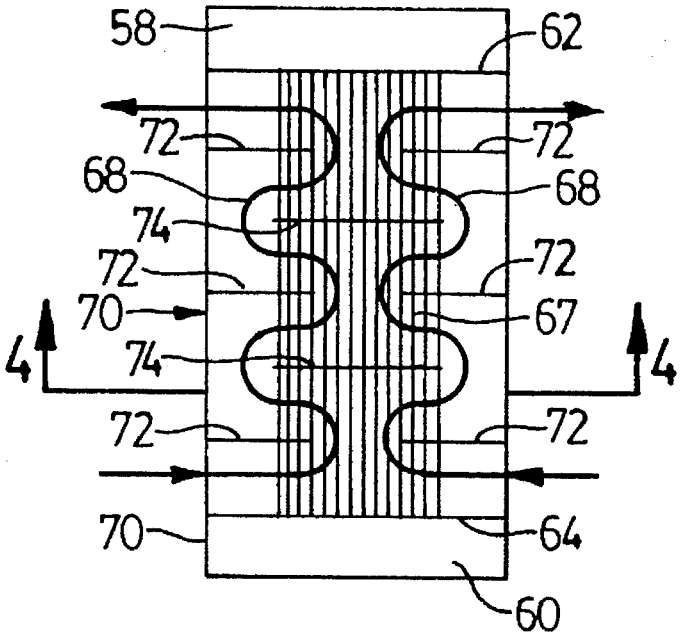
FIG. 4A is a schematic view of a baffle arrangement for a double segmental baffled exchanger with no tubes in the outer baffle windows according to the prior art.
Figure 4B:
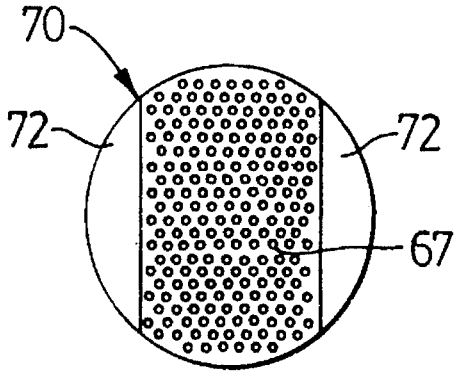
FIG. 4B is a cross-section along line 4—4 in FIG. 4A.

FIGS. 4A and 4B show the typical baffle arrangements for an exchanger using double segmental baffles with no tubes in the outer baffle windows. Here the exchanger 70 with top and bottom vestibules 58, 60 and top and bottom tube sheets 62, 64 contains a tube bundle 67 and has spaces on each side. Unlike the single segmental baffles, the double segmental baffles are divided into outer baffles 72 and inner baffles 74, and the flow pattern is from the outside towards the central core of the exchanger and then transversely outwardly to the shell of the exchanger.

Figure 5A:
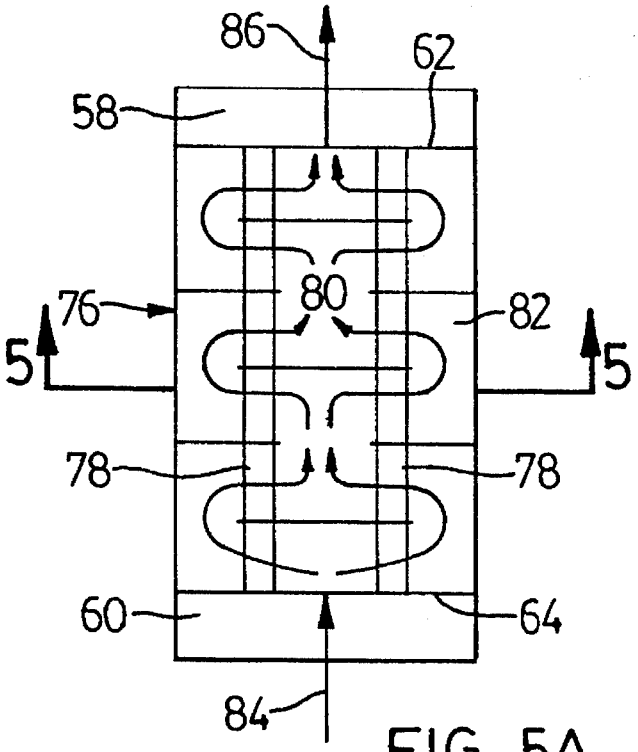
FIG. 5A is a schematic view of a baffle arrangement for an exchanger with disc and donut baffles and no tubes in the baffle windows according to the prior art.
Figure 5B:
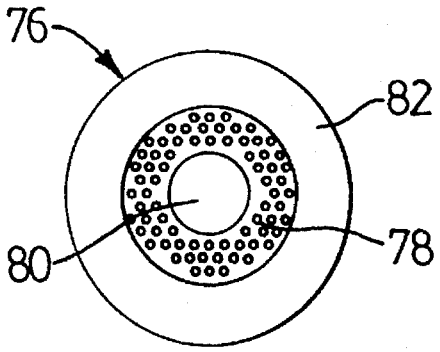
FIG. 5B is a cross-section along line 5—5 in FIG. 5A.

FIGS. 5A and 5B show the typical baffle arrangement for an exchanger 76 with top and bottom vestibules 58, 60 and top and bottom tubesheets 62, 64. In this arrangement the tubes are located in an essentially annular ring 78, with a core space 80 which is free of tubes and an annular space 82 which is also tube free. The shell side fluid travels from inlet stream 84 up into the tube bundle along the longitudinal exchanger axis and flows out the top of the exchanger as outlet stream 86.

Each of the general type of heat exchangers described above may be modified to incorporate the internal bypass valve means of the instant invention. Accordingly, each of the heat exchangers may be modified by including valve means which is operable between a first position and a second position. The valve means is positioned within the shell of the heat exchanger and co-operates with the baffle means so as to adjust the flow of shell side fluid through the shell. In addition, actuator means which is used for adjusting the position of the valve means is also provided. The actuator means may be provided internal or external to the heat exchanger. If the actuator means is positioned internal to the heat exchanger, then control means which activates the actuator means is preferably positioned external to the heat exchanger, such as on the shell of the heat exchanger. Thus, the position of the valve means may be adjusted from the exterior of the heat exchanger allowing the valve means to be adjusted during operation of the heat exchanger. Generally, the valve means and actuator means may be incorporated into any heat exchanger. However, it is preferred that the valve means is positioned in a window which does not include any tubes thus allowing a simple, mechanically efficient valve means to be utilized.

Figure 6A:
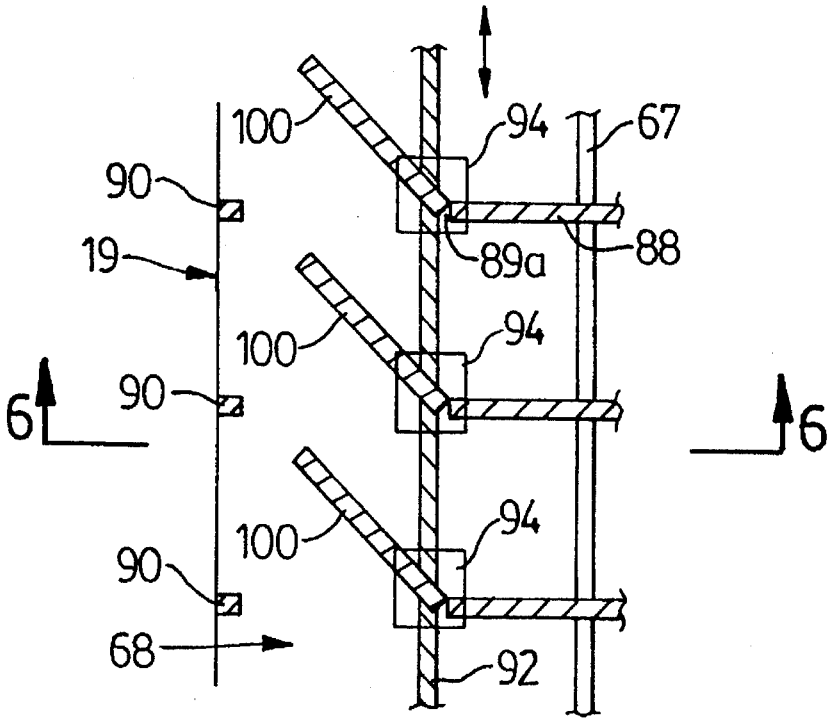
FIG. 6A is an enlargement of portion "A" of the single segmental baffled exchanger shown in FIG. 3 wherein the baffle includes a valve means according to the instant invention.

FIG. 6A shows an enlargement of portion A of FIG. 3A which, as described above, shows a single segmental baffled heat exchanger. As shown in FIG. 6A, window 68 extends between heat exchanger shell 19 and tube bundle 67. (See also FIG. 6B). Baffle 66 which was shown in FIG. 3A has been replaced by internal bypass valve means according to the instant invention. In particular, FIG. 6A demonstrates a single segmental baffle in which a portion of baffle 66 has been replaced by a valve means which is a vane type valve. Accordingly, each baffle 66 comprises baffle member 88, valve member 100 and annular segment 90. Baffle member 88 is effectively coextensive with the portion of baffle 66 of FIGS. 3A and 3B which passes around the tube bundle. Baffle member 88 extends from first end 89*a* which is within baffle window 68, transversely inwardly around tube bundle 67 to end 89*b* which is within the other baffle window 68. As shown in particular in FIG. 6B, annular segment 90 extends along the inner side of shell 19 along the outside edge of window 68. Valve member 100 extends from end 89A of baffle member 88 to annular segment 90.

Figure 6B:
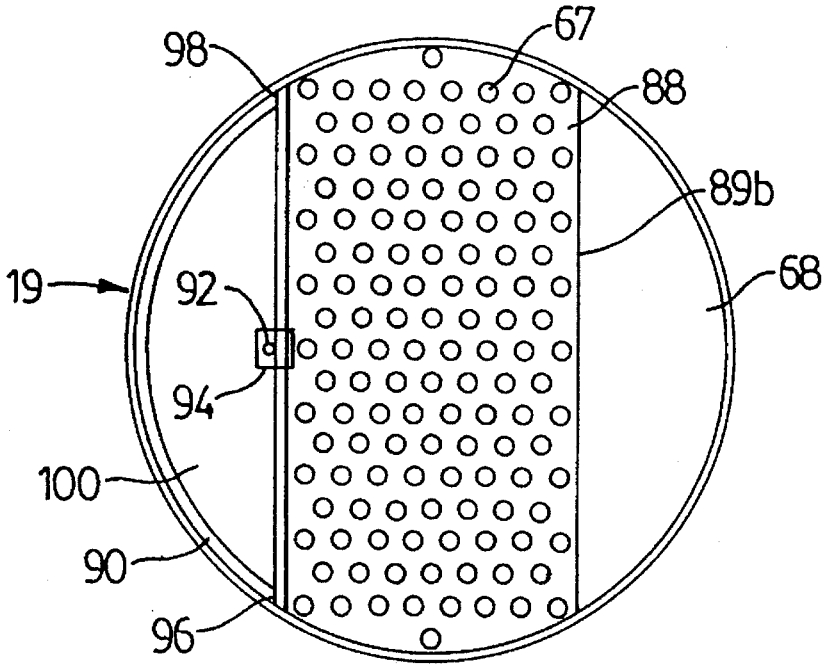
FIG. 6B is a cross-section along line 6—6 in FIG. 6A.

Valve member 100 pivots along axis 96–98 (on a pivot shaft or hinge, not shown) from the open position shown in FIG. 6A, to the closed position as shown in FIG. 6B. When valve member 100 is in the closed position, annular member 90, valve member 100 and baffle member 88 effectively provide a complete baffle extending from shell 19 across window 68 and tube bundle 67.

A shaft 92 extends longitudinally within window 68 adjacent end 89*a* of baffle member 88. At each valve member 100, an actuator 94 is provided. Actuator 94 is adapted to move valve member 100 incrementally between the closed position and an open position in response to movement of shaft 92. Actuator 94 may include a cam member and valve member 100 may include a protrusion that rides along the surface of the cam member. Thus, as shaft 92 is raised and lowered, movement of the protrusion from valve member 100 along the cam member will cause valve member 100 to be raised or lowed. (Not shown). Alternate means which would be utilized include a mechanism for rotating shafts on which the valves are supported so that the valves swing up and down about the inner cord.

When valve member 100 is in the closed position, then annular member 90, valve member 100 and baffle member 88 define a solid baffle which will deflect the shell side fluid in the same manner as baffle member 66 of FIG. 3A. Since window 68 extends upstream and downstream of valve member 100, as valve member 100 is opened, some of the shell side fluid will not be deflected across tube bundle 67 but will continue to pass longitudinally through window 68. Accordingly, by controlling the position of valve member 100, the amount of shell side fluid which passes across tube bundle 67 gaining or losing heat may be controlled and the amount of heat transferred between the shell side fluid and the tube side fluid may be regulated.

It will be appreciated that, according to some designs, only one valve member 100 may be required in a heat exchanger. Alternately, every baffle may incorporate therein a bypass valve. Further, each valve may be independently operable or, as in the case shown in FIG. 6A, each valve may be actuated in unison by a single shaft. It will also be appreciated that various different types of valve members may be utilized. By placing the valve member in a tube free window, a mechanically simple valve member may be incorporated as part of a baffle.

Figure 7A:
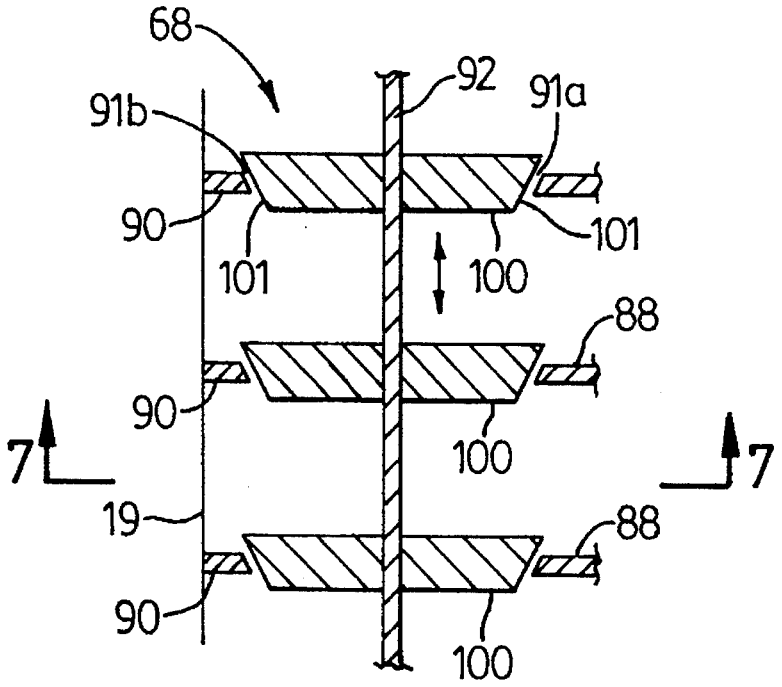
FIG. 7A is an enlargement of portion "A" of the single segmental baffled exchanger shown in FIG. 3 wherein the baffle includes an alternate valve means according to the instant invention.
Figure 7B:
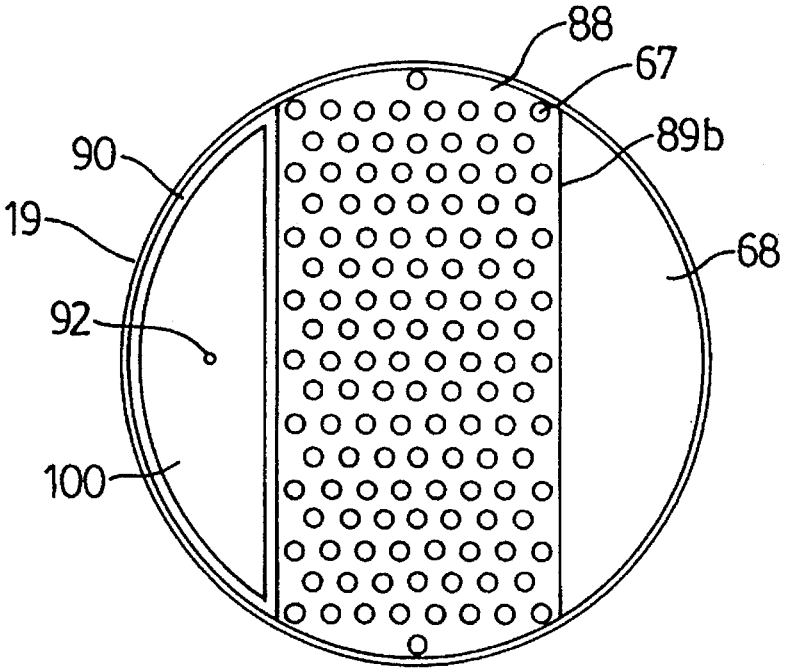
FIG. 7B is a cross-section along 7—7 in FIG. 7A.

Other types of valve arrangements may be utilized. As shown in FIGS. 7A and 7B, valve member 100 may be mounted for longitudinal movement on shaft 92. Valve member 100 may have angled edges 101. Baffle member 88 and annular segmental member 90 may have complimentary angled edges 91*a* and 91*b* respectively. Accordingly, when shaft 92 is in the closed position, edges 91*a*, 91*b* and 101 co-operate to form a seal which directs the shell side fluid across tube bundle 67. When shaft 92 is raised, then the shell side fluid may pass upwardly through window 68 without being completely diverted across to bundle 67.

Figure 8:
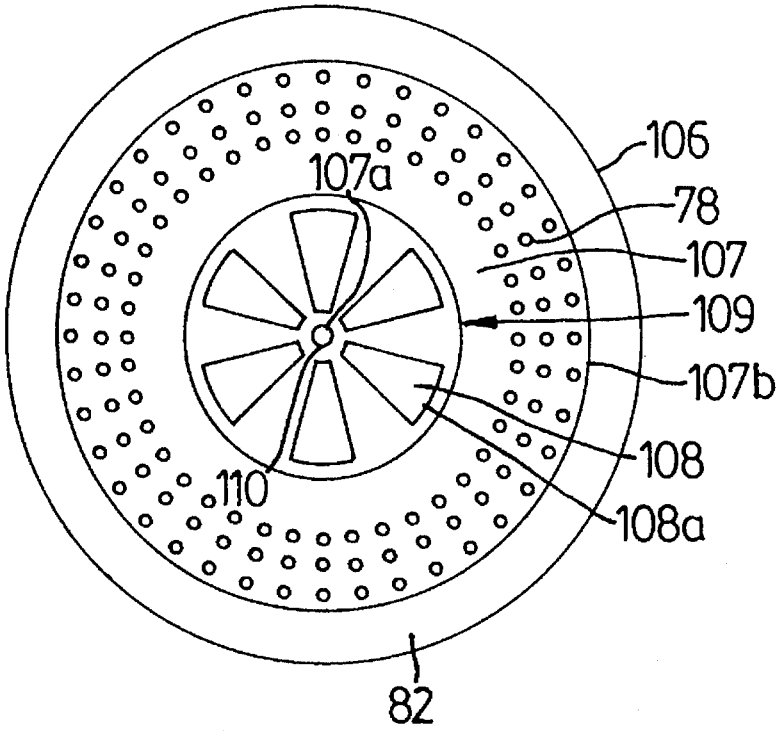
FIG. 8 is the cross-section of the heat exchanger as shown in FIG. 5B wherein the baffle has been amended to include a further valve means according to the instant invention.

FIG. 8 demonstrates another type of valve member which may be utilized according to the instant invention. According to this embodiment, a disk and donut arrangement of the heat exchanger is utilized. The heat exchanger has a shell 106 and an annular bundle of tubes 78. Annular space 82 extends between shell 106 and tube bundle 78. The valve member is positioned within the core space 80 which is shown in FIG. 5A and may be formed as one of the inner baffles. Referring to FIG. 8, baffle member 107 extends from a first radially inner edge 107*a* which is adjacent the centre of the heat exchanger, to a second radially outer edge 107*b* which is positioned adjacent to annular space 82. Shaft 110 is a longitudinally extending shaft which is located at the centre of the heat exchanger and passes through baffle member 107. A plurality of pie shaped openings 108 are provided in baffle member 107.

Rotating disk 109 is mounted on shaft 110. Disk 109 also contains a plurality of pie shaped openings 108*a*. Preferably, the pie shaped openings 108 and 108*a* which are provided in both baffle member 107 and rotating disk 109 respectively are identical in size and position. Accordingly, as shown in FIG. 8, when rotating disk 109 is in a first open position, the pie shaped openings 108 and 108*a* align and the shell side fluid may pass through pie shaped openings 108 and 108*a* bypassing a baffle pass. As disk 109 is rotated, the amount of shell side fluid passing through pie shaped openings 108 and 108*a* decreases and, if the pie shaped openings are appropriately spaced, rotating disk 109 may be positioned such that each pie shaped opening in rotating disk 109 faces a solid portion of baffle member 107 and each pie shaped opening 108 in baffle member 107 faces a solid portion of rotating disk 109 thus closing the bypass valve. When the bypass valve is closed, the fluid must then travel around the baffle 107 (hence contacting the tubes 78) instead of flowing partly through baffle 107.

Many other variations of the concept can be used, including butterfly vanes which have a central shaft, cones which are raised or lowered into holes in the relevant baffles, or simple disks which are moved away from holes in the baffles.

Figure 9:
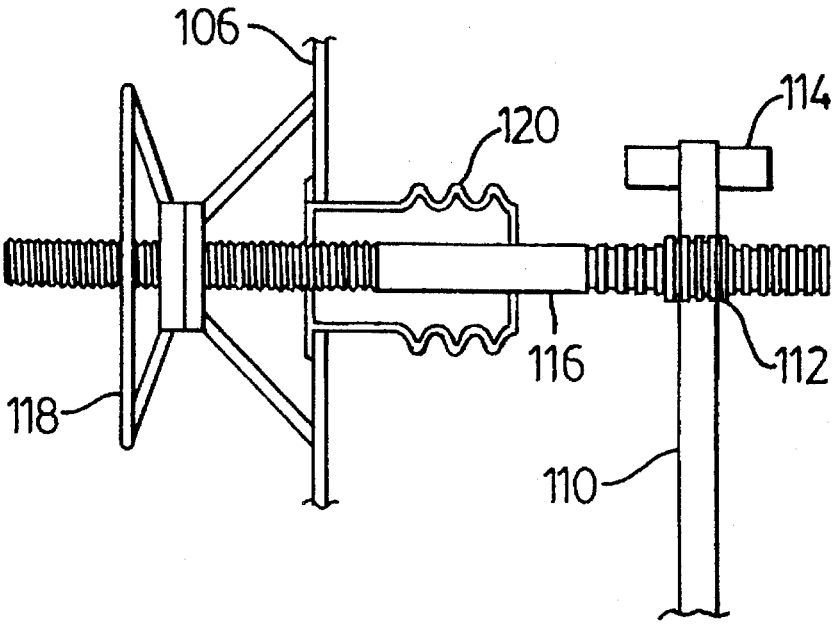
FIG. 9 is a schematic view of a drive mechanism for a valve means according to the instant invention.

The actuator means for the bypass valves is preferably positioned external to the shell of the heat exchanger. Accordingly, actuation of the bypass valves on the inside of the heat exchanger may be effected by external means. For example, FIG. 9 shows an external actuation means which may be used in conjunction with the bypass valve means shown in FIG. 8. In this case, shaft 110 has a toothed gear 112 provided thereon. Shaft 110 is mounted in bearing or guide member 114. Bearing or guide member 114 is mounted within the heat exchanger (not shown). A toothed shaft 116 engages gear 112 and moves at a right angle to shaft 110. Toothed shaft 116 extends from a point external to the heat exchanger (outwardly from shell 106), through expansion joint 120 to shaft 110. Expansion joint 120 allows the shaft to extend through shell 106 without any process fluid leaking to the surrounding environment. Nut 118 is threaded on to the external portion of toothed shaft 116. Rotation of nut 118 causes toothed shaft 116 to rotate and, thus, shaft 110 to rotate thus opening or closing pie shaped openings 108. Various other actuation means may be utilized depending upon the type of valve member which is utilize. In many cases, the actuation means will comprise a mechanism which may cause a shaft to either rotate to pivot or to be raised or lowered.

Figure 10:
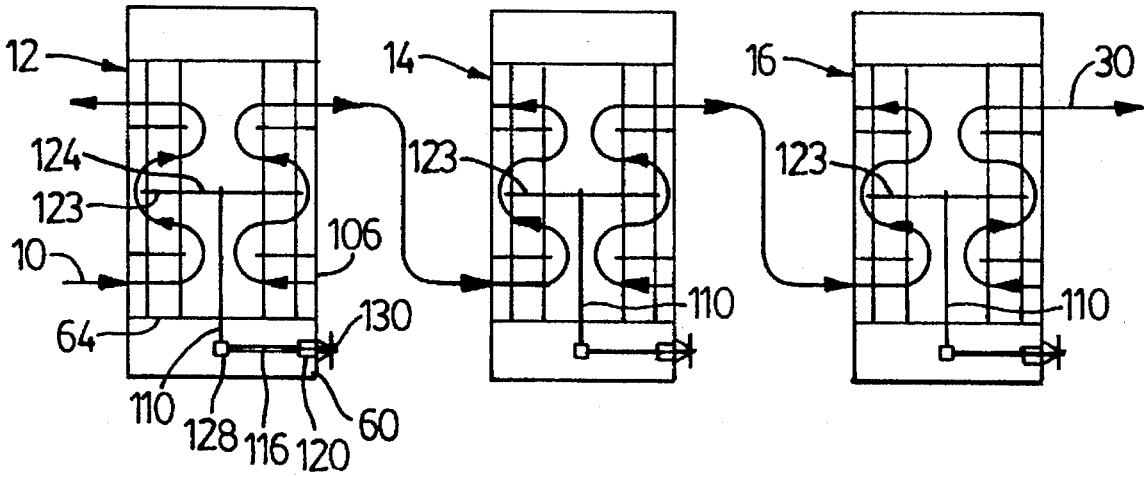
FIG. 10 is a schematic view of a bypass system for a metallurgical sulfuric acid plant according to the instant invention.

FIG. 10 shows the exchangers of FIG. 1 in which the internal bypass valves according to this invention are used. The incoming gas stream 10 passes through the exchangers 12, 14, and 16 in series as before but the whole bypass system is contained in the exchangers. In each exchanger, baffles are shown as being of the disk and donut type. A valve 124 is mounted in each disk baffle 123. Each valve 124 is driven by a shaft 110 which is actuated by external actuation means located on the bottom of the heat exchanger. In cold exchanger 12, the valve 124 with shaft 110 provide the bypass with the shaft projecting through the lower tube sheet 64 into a sealed space 128 which contains gear 112, bearing 114, and toothed driveshaft 116 previously described. The driveshaft 116 connects to the expansion joint 120 and through the wall 106 of the lower vestibule 60 to an external actuator 130 such as nut 118. Similar devices are shown in the exchangers 14 and 16.

Figure 11:
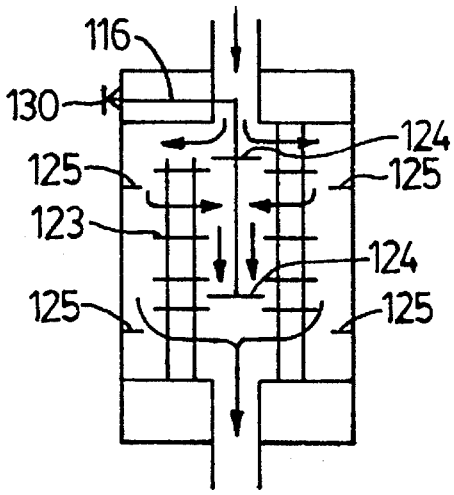
FIG. 11 is a schematic of a heat exchanger according to the instant invention allowing full bypassing of the exchanger on the shell side.

FIG. 11 shows a bypass arrangement which may be needed where there is a need for an almost total bypassing of the exchanger for temperature control. Here a four pass exchanger is shown in which the incoming gas enters the core through the top and flows into the core space. The gas leaving similarly leaves from the core space. Both disk baffles 123 are provided with valves 124, thus allowing the core of the exchanger to be converted into a pipe through which the shell side fluid can flow thus reducing the flow through the tube bundle. In this case the driveshaft 116 is driven by an external actuator 130 located on an upper portion of the outside the exchanger but otherwise the drive mechanism may be similar to that described above with respect to FIG. 9. Because the bypass path is a straight tube and the path around the baffles is the usual tortuous path, most of the fluid will take the bypass path when the valves 124 are open (if their open area is large enough). This reduces or avoids the need for a separate valve (which can also be within the shell) to throttle the flow around the baffles. For example, throttling valves 125 may also be provided. In one mode of operation, throttling baffles 125 may be open. In this mode of operation, some bypassing of the baffle passes will occur. If complete bypassing is required, then all of throttling valves 125 may be closed. Thus the shell side fluid may effectively pass through the centre of the heat exchanger. Such bypassing may be sufficient to dispose of the requirement for external bypass means, or to at least decrease the volume of fluids which must pass through external bypass means.

As discussed above, one of the problems with external bypasses is that there may be a significant temperature difference between the temperature of the bypassed fluid and the temperature of the fluid which passes through the heat exchanger when the two streams are rejoined. Depending upon the temperature difference between the streams, there may be insufficient mixing of the streams before the joined stream passes to a next operation in a plant. If the next operation requires a substantially uniform temperature for the process fluid, such as in the case of catalysis, then the use of an external bypass is not desirable. By using the internal bypass valves of the instant invention, sufficient mixing of the bypassed fluid may be obtained. For example, the bypassing in the heat exchanger may occur at any of the baffles in the heat exchanger except for the last baffle. Thus, all of the shell side fluid passing through the heat exchanger, namely that portion which has bypassed some of the baffle passes and that portion which has travelled across the tube bundles, will be rejoined at the last baffle pass and will travel across the tube bundle during the last pass. The travel across the tube bundle may provide sufficient mixing of the shell side fluid thus creating a uniform temperature in the shell side fluid as it exists from the heat exchanger. Depending upon the temperature difference, two or more baffle passes may be utilized to achieve this result.

A further advantage of the instant invention is that, in some cases, there is a significant danger of condensation occurring if the heat exchanger is too efficient in cooling a specific stream. Thus, by monitoring the exit temperatures from the shell side fluid and the tube side fluid, the positioning of one or more of the valve members 100 may be adjusted to ensure that condensation does not occur. Thus, the amount of bypassing may be reduced on an as needed basis. While the forgoing discussion has discussed in particular the gas handling in sulfuric acid plants, this invention may be used in any case where regulation of the heat transfer between a shell side fluid and a tube side fluid in a shell and tube heat exchanger is required.

Figure 12:
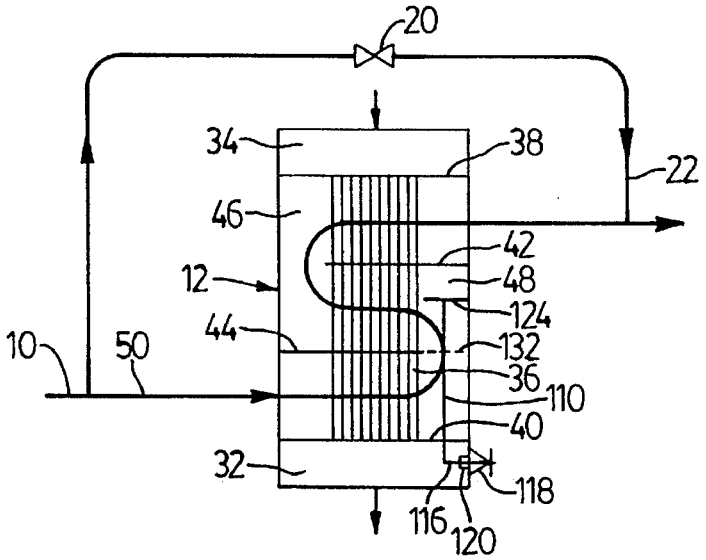
FIG. 12 is a schematic view of a further heat exchanger according to the instant invention; and, FIG. 13 is a schematic view of the exchanger train of FIG. 1 incorporating internal bypass means according to the instant invention.

According to a further preferred embodiment of the instant invention, the internal bypass means may be utilized in conjunction with external bypass means to regulate the amount of fluid bypassing the heat exchanger. For example, as shown in FIG. 12, the heat exchanger includes external bypass means which is regulated by valve 20. However, when valve 20 is fully opened, insufficient shell side fluid may be diverted around exchanger 12. Accordingly, internal bypass valve 124 may be provided. Bypass valve 124 may be of any of the types discussed above. Bypass valve 124 is positioned so as to operably engage with baffle 44 to regulate the amount of shell side fluid passing through exchanger 12. Thus, when in a fully open position, as shown in FIG. 12, the flow of shell side fluid through exchanger 12 may be effectively unimpeded by valve means 124. As valve means 124 is moved to the closed position as represented by dashed line 132 in FIG. 12, the decreasing opening between valve means 124 and baffle 44 will cause some of the shell side fluid to pass through the external bypass means. When valve means 124 is in the fully closed position, as represented by dashed line 132, then all of the shell side fluid will be diverted through the external bypass means. In this case bypass valve 124, rather than bypassing flow which would normally travel around a baffle, is blocking such flow and causing fluid to bypass around the heat exchanger.

The bypass means may again be operated by external actuation means. As shown in FIG. 12, shaft 110 may be operatively connected to drive shaft 116. Drive shaft 116 passes through expansion joint 120, through the shell of the heat exchanger to a point external of the heat exchanger. Nut 118 may be threaded on to the external portion of drive shaft 116. Nut 118 causes drive shaft 116 to rotate and, through mechanical connection means (not shown) cause shaft 110 to be raised or lowered thus opening or closing bypass means 124.

Figure 13:
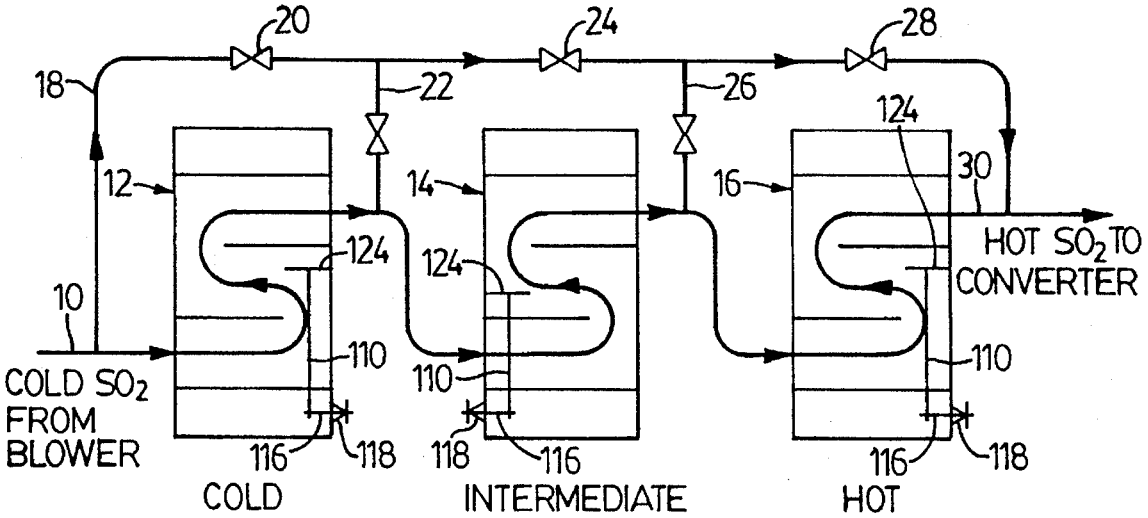

Referring to FIG. 13, bypass means 124 are shown in each heat exchanger of the heat exchanger train. It should be appreciated that bypass means 124 may be positioned so as to co-operate with any baffle in the heat exchanger. In addition, the heat exchanger may include a bypass valve for reducing the amount of flow of the shell side fluid as demonstrated by FIG. 12 and a internal bypass means for permitting individual baffle passes to be bypassed as shown in FIG. 6A.

We claim:

1. A shell and tube heat exchanger for exchanging heat between a shell side fluid and a tube side fluid comprising:

(a) a longitudinally extending shell;

(b) a plurality of tubes extending longitudinally in said shell, said tubes being positioned to define a first and a second longitudinally extending window;

(c) a plurality of baffle means positioned within said shell between the entry port for the shell side fluid and the exit port for the shell side fluid, said first and said second windows extending through said baffle means for directing the shell side fluid to flow across said tubes, the temperature of the shell side fluid where it exits from said heat exchanger being sufficiently uniform to define a stream effectively having a single temperature;

(d) at least one valve means positioned within said first longitudinally extending window and operable between a first open position and a second closed position, each of said valve means co-operating with one of said baffle means for adjusting the flow of the shell side fluid in said shell in response to the temperature of the shell side fluid or the tube side fluid where said fluid exits from said heat exchanger; and, (e) actuator means coupled to said valve means for moving said valve means between said first and second positions such that, when said valve means is in said second closed position, said baffle means and said valve means define a continuous surface and the shell side fluid is deflected by said valve means and said baffle means to pass through said second window, and as said valve means is moved to said first open position, the amount of shell side fluid passing through said valve means, and accordingly through said first window in said baffle means, from the upstream side of said baffle means to the downstream side of said baffle means increases.

2. The heat exchanger as claimed in claim 1 wherein said actuator means is positioned external to said shell.

3. The heat exchanger as claimed in claim 1 wherein said actuator means is positioned internal to said shell and said actuator means is activated by control means external to said heat exchanger.

4. The heat exchanger as claimed in claim 1 wherein each of said valve means has an associated actuator means so that each of said valve means is independently operable.

5. The heat exchanger as claimed in claim 4 wherein said actuator means are positioned external to said shell.

6. The heat exchanger as claimed in claim 4 wherein said actuator means are positioned internal to said shell and said actuator means is activated by control means external to said heat exchanger.

7. The heat exchanger as claimed in claim 1 wherein said baffle means closest to said exit port extends through said first window to cause said shell side fluid to travel across said tubes at least once prior to exiting from said heat exchanger.

8. The heat exchanger as claimed in claim 7 wherein said heat exchanger has one exit port.

9. The heat exchanger as claimed in claim 1 wherein said baffle means closest to said exit port extends through said first window to cause said shell side fluid to travel across said tubes at least twice prior to exiting from said heat exchanger.

10. The heat exchanger as claimed in claim 1 wherein a second valve means is positioned within said second longitudinally extending window and operable between a first open position and a second closed position, said second valve means co-operating with one of said baffle means which has a co-operating valve means in said first window, for adjusting the flow of the shell side fluid through said second window.

11. The heat exchanger as claimed in claim 1 wherein a second valve means is positioned within said second longitudinally extending window and operable between a first open position and a second closed position, said second valve means co-operating with each of said baffle means which has a co-operating valve means in said first window, for adjusting the flow of the shell side fluid through said second window.

12. A method of operating a heat exchanger for exchanging heat between a shell side fluid and a tube side fluid having:

(a) a longitudinally extending shell, said shell having an entry port for the shell side fluid and an exit port for the shell side fluid;

(b) a plurality of tubes extending longitudinally in said shell, said tubes being positioned to define a first and a second longitudinally extending window;

(c) a plurality of baffle means positioned within said shell between said entry port for the shell side fluid and said exit port for the shell side fluid, said first and said second windows extending through said baffle means for directing the shell side fluid to flow across said tubes, the temperature of the shell side fluid where it exits from said heat exchanger being sufficiently uniform to define a stream effectively having a single temperature;

(d) at least one valve means positioned within said first longitudinally extending window and operable between a first open position and a second closed position, each of said valve means co-operating with one of said baffle means for adjusting the flow of the shell side fluid in said shell in response to the temperature of the shell side fluid or the tube side fluid where said fluid exits from said heat exchanger; and, (e) actuator means coupled to said valve means for moving said valve means between said first and second positions comprising the steps of:

(f) monitoring the temperature of the shell side fluid at a predetermined point; and, (g) using said actuator means to adjust the position of said valve means to adjust the amount of shell side fluid passing through at least one of said valve means from a position upstream of at least one of said baffle means to a position downstream of said at least one of said baffle means and the amount of shell side fluid flowing across said tubes to maintain the temperature of the shell side fluid at said predetermined point at a predetermined level.

13. The method as claimed in claim 12 wherein said heat exchanger is connected to external by pass means for diverting at least a portion of the shell side fluid from said entry port and conveying the diverted shell side fluid to a position downstream from said exit port whereby, as said valve means is adjusted from said first position to said second position, the amount of shell side fluid passing through said external by pass means increases.

14. The method as claimed in claim 13 wherein said external by pass means includes external by pass valve means for regulating the volume of shell side fluid diverted by said by pass means, said method further comprising the step of adjusting the position of said external by pass valve means in combination with the adjustment of the position of said valve means to maintain the temperature of the shell side fluid at said predetermined point at a predetermined level.

15. The method as claimed in claim 12 wherein said heat exchanger has a plurality of baffle means and a plurality of valve means, said baffle means and valve means positioned at discrete locations along the length of said heat exchanger, and step (g) includes adjusting the position of each of said valve means to adjust the amount of shell side fluid passing through each of said valve means from a position upstream of said baffle means to a position downstream of said baffle means and the amount of shell side fluid flowing across said tubes at each of said baffle means.

16. The method as claimed in claim 12 wherein said actuator means is positioned external to said shell.

17. The heat exchanger as claimed in claim 16 wherein each of said valve means has an associated actuator means so that each of said valve means is independently operable.

18. The method as claimed in claim 12 wherein said actuator means is positioned internal to said shell and said actuator means is activated by control means external to said heat exchanger.

19. The method as claimed in claim 12 wherein (a) said tubes are positioned to define a second longitudinally extending window within said shell;

(b) said baffle means extend through said second window;

(c) said heat exchanger has a plurality of baffle means and a plurality of valve means, said baffle means and valve means positioned at discrete locations along the length of said heat exchanger;

(d) said valve means includes throttling valve means and by pass valve means;

(e) said throttling valve means is positioned within said first window and said throttling valve means and said baffle means define a continuous surface extending across the interior of said shell such that, when said throttling valve means is in said first open position, the shell side fluid may pass through said first window and as said throttling valve means is moved to said second closed position, the amount of shell side fluid passing through said heat exchanger is reduced and when said throttling valve means is in said second closed position, the shell side fluid is prevented from passing through said heat exchanger; and, (f) said by pass valve means is positioned within said second window and forms part of said baffle means such that, when said by pass valve means is in said second closed position, said baffle means and said by pass valve means define a continuous surface and the shell side fluid is deflected by said valve means and said baffle means to pass across said tubes, and as said by pass valve means is moved to said first open position, the amount of shell side fluid passing through said by pass valve means, and accordingly through said baffle means, from the upstream side of said baffle means to the downstream side of said baffle means increases; and step (g) includes adjusting the position of each of said valve means to adjust the amount of shell side fluid passing through each of said windows at each of said baffle means and accordingly the amount of shell side fluid flowing across said tubes at each of said baffle means.

20. The method as claimed in claim 19 wherein said tubes are arranged as a longitudinally extending annular array defining an inner central tube free core and an outer annular tube free space, one of said first window and said second window comprising said inner central tube free core and the other of said first window and said second window being said outer annular tube free space.

21. The method as claimed in claim 12 wherein said baffle means closest to said exit port extends through said first window to cause said shell side fluid to travel across said tubes at least once prior to exiting from said heat exchanger.

22. The method as claimed in claim 21 wherein said heat exchanger has one exit port.

23. The method as claimed in claim 12 wherein said baffle means closest to said exit port extends through said first window to cause said shell side fluid to travel across said tubes at least twice prior to exiting from said heat exchanger.

24. The method as claimed in claim 12 wherein a second valve means is positioned within said second longitudinally extending window and operable between a first open position and a second closed position, said second valve means co-operating with one of said baffle means which has a co-operating valve means in said first window, and said method further comprises the step of adjusting the position of said second valve means to adjust the flow of the shell side fluid through said second window such that when said valve means is opened, the amount of shell side fluid passing through said first window at the position where said valve means is located increases as said second valve means moves from said open position to said second position.

25. The method as claimed in claim 12 wherein a second valve means is positioned within said second longitudinally extending window and operable between a first open position and a second closed position, said second valve means co-operating with each of said baffle means which has a co-operating valve means in said first window, and said method further comprises the step of adjusting the position of said second valve means to adjust the flow of the shell side fluid through said second window such that when said valve means is opened, the amount of shell side fluid passing through said first window at the position where said valve means is located increases as said second valve means moves from said open position to said second position.

* * * * *